US005119609A

United States Patent [19]

Tait et al.

[11] Patent Number: 5,119,609

[45] Date of Patent: Jun. 9, 1992

[54] PLASTIC NAILING FIN FOR WINDOW OR DOOR ASSEMBLY

[75] Inventors: Timothy T. Tait, Granger, Ind.; David L. Kochendorfer, Warsau, Wis.

[73] Assignee: Aeroquip Corporation, Maumee, Ohio

[21] Appl. No.: 698,167

[22] Filed: May 10, 1991

[51] Int. Cl.[5] ..... E06B 1/04

[52] U.S. Cl. ..... 52/213; 52/403; 206/321

[58] Field of Search ..... 206/321, 325, 451; 49/380; 52/213, 403, 215

[56] References Cited

U.S. PATENT DOCUMENTS 3,623,288 11/1971 Horowitz ..... 52/293

4,184,297 1/1980 Casamayor ..... 52/202

4,821,472 4/1989 Tix ..... 52/213

4,999,957 3/1991 Kessler ..... 52/213

*Primary Examiner*—James L. Ridgill, Jr.

*Attorney, Agent, or Firm*—Emch, Schaffer, Schaub & Porcello Co.

[57] ABSTRACT

A plastic nailing fin for use with a window assembly includes a first strip of plastic material moveable from a position overlying the viewing surface of a window frame assembly to a position permitting its attachment to a support structure, a second strip of material integral with said first strip and joining it at a corner, said second strip having first and second segments separated by an integral hinge about which said first segment and said first strip of plastic material may be foldable.

29 Claims, 4 Drawing Sheets

PLASTIC NAILING FIN FOR WINDOW OR DOOR ASSEMBLY

DESCRIPTION

1. Technical Field

The present invention relates to an extruded plastic nailing fin for use with a window or door assembly which can be assembled with such window or door assembly at the factory and shipped therewith without incurring substantial risk of damage.

2. Background Art

Nailing fins have commonly been used for attaching window assemblies and door assemblies in the construction of homes and other structures. It is desirable that nailing fins be attached to window and door assemblies at the factory so that they can be shipped to the construction site with such window and door assemblies. Some prior art nailing fins took up significant amounts of space in their respective shipping container with the result that the cost of shipping such window and door assemblies with those types of nailing fins attached was considerably greater than was required for shipping similar assemblies without nailing fins attached.

U.S. Pat. No. 4,821,472 (copy enclosed), which is incorporated herein by reference, discloses a hinged nailing fin for a window assembly which permits the portion of such nailing fin which contains the nail holes to be folded back against the edge of the assembly so that it does not take any space in the shipping container and yet will spring into place ready for installation when the assembly is removed from the shipping container. The nailing fin disclosed in such patent utilizes a hinge material made from an elastomeric material different from the material used for the other portions thereof and has a specific design configuration.

DISCLOSURE OF THE INVENTION

The nailing fin of the present invention has a new and unique construction which permits the entire fin including the hinge to be easily and readily extruded using a single plastic material or, if desired, having the hinge portion co-extruded using a different material from other portions. The design of the present nailing fin permits it to be attached to an edge of the frame of a window or door assembly. The design of the nailing fin of the present invention in relation to the frame is such that when it is attached to the edge of a frame in its "as molded" or "as extruded" form, one leg will over-lie the front or viewing surface of frame. Thus, the plastic nailing fin of the present invention not only minimizes the space required for shipping a window assembly with such nailing fin attached, it also provides protection during shipment for such viewing surface. It includes a first leg having means for attaching it to the edge of a window or door frame, a second leg disposed in a first position at substantially right angles to the first leg and hinge means in the first leg spaced between the means for attaching the nailing fin to the edge of the frame and the second leg. The hinge means divides the first leg into interior and exterior segments with the exterior segment being foldable about the hinge means from a position aligned with and extending from the interior segment to a position folded upon and in engagement with such interior segment. Upon such folding the second leg is moved from the first position overlying the viewing surface of the frame to a second position at substantially right angles to said first leg but in an opposite direction from said first position extending away from the frame for nailing to a support structure such as a wall. Means are also provided on the nailing fin for retaining such exterior segment in the folded position.

BEST MODE FOR CARRYING OUT INVENTION

Figure 1:
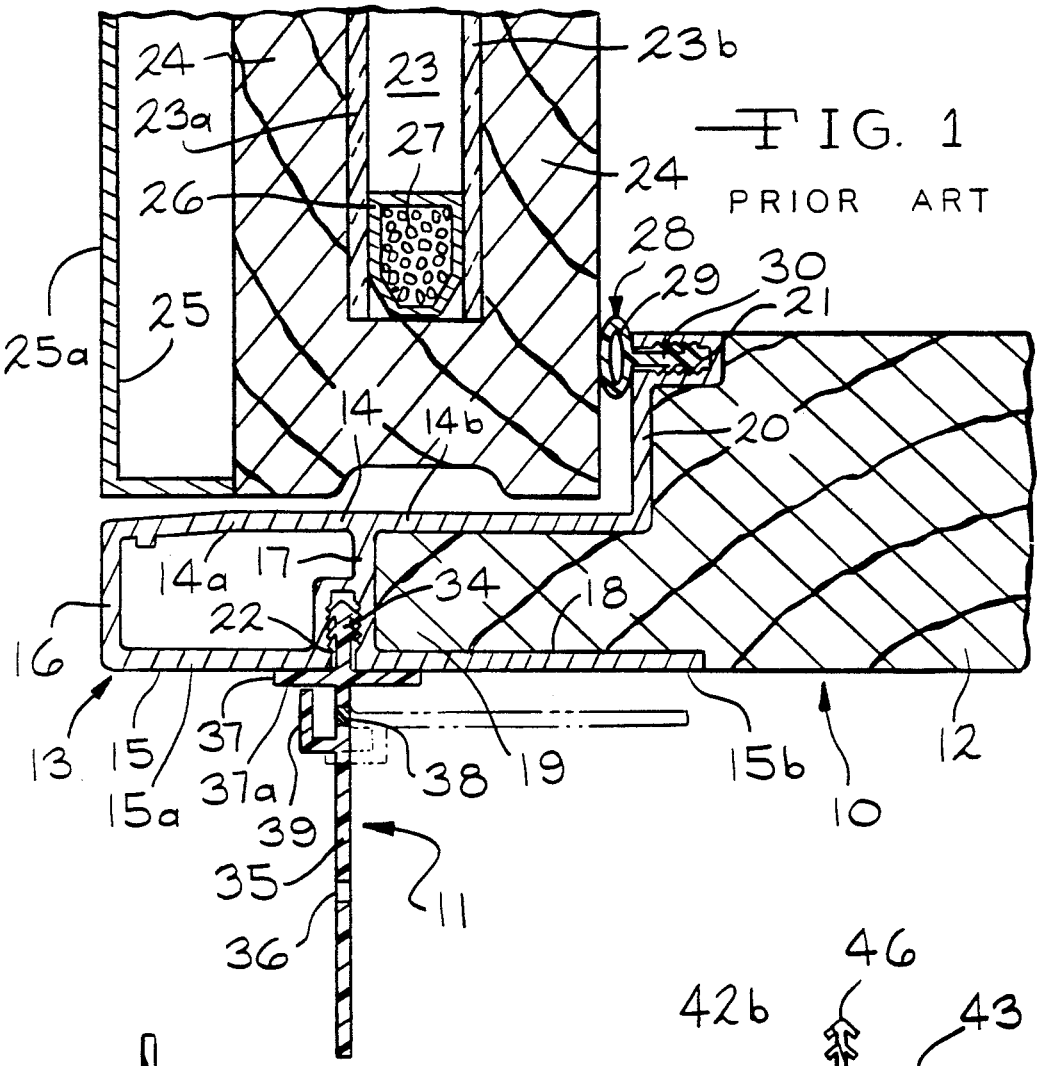
FIG. 1 PRIOR ART
FIG. 1 is a sectional view showing a prior art nailing fin secured to a window assembly.

Referring now FIG. 1, there is shown a typical window assembly generally designated by the numeral 10 having one type of prior art nailing fin generally designated by the numeral 11 secured thereto. The window assembly includes a wooden frame 12 having an aluminum frame cover 13 permanently engaged thereto. The frame cover 13 includes spaced apart inner and outer walls 14 and 15, respectively, separated by a front web 16 and an intermediate web 17. The intermediate web 17 divides the inner wall 14 into a front section **14*a* and a rear section 14*b* and the outer wall 15 into a front section 15*a* and a rear section 15*b* and cooperates with the respective rear sections 14*b* and 15*b* to define a channel 18 into which a forwardly extending leg 19 of the wooden frame 12 may be received and retained. The frame cover 13 also includes a leg 20 extending at right angles from the end of the rear section 14*b* of the inner wall 14. The leg 20 supports at its innermost end a U-shaped channel section defining a weatherstrip groove 21 for receiving a member as hereinafter described. A second groove 22 or kerf is located at the intersection of the front section 15*a* and the intermediate web 17** and opens outwardly of the outer wall.

The combination of the wooden frame 12 and the aluminum frame cover 13 serve to support the remainder of the window assembly 10 including an insulated glass panel member 23 supported in a wooden sash 24 covered by an aluminum sash cover 25. The aluminum sash cover 25 may be affixed to the wooden sash 24 by a plurality of screws or fastening devices (not shown) which maintain the viewing surface **25*a* of the aluminum sash cover 25 spaced from the wooden sash 24. The glass panel member 23 may include a pair of spaced apart glass window panes 23*a*, 23*b* with a hollow aluminum spacer 26 positioned therebetween. The spacer 26** may have dessicant material 27 therein and extends around the periphery of such window panes 23*a* and 23*b*. Normally the viewing surface 25*a* of the aluminum sash cover 25 as well as the non-viewing surfaces will have paint of finished quality applied at the factory. As a result, it is not necessary to paint such viewing surface 25*a* at the building site provided such viewing surface is not damaged during shipment. In contrast, window assemblies having wood frames with a wooden viewing surface are typically painted at the job site thereby increasing the cost of window installation.

A weatherstrip 28 having a collapsible bulb 29 and a barbed stem 30 is positioned in the weatherstrip groove 21 and engages the rear surface of the wooden sash 24. The wooden sash 24 with the aluminum sash cover 25 and glass panel member 23 is secured to the aluminum frame cover 13 by means (not shown). The window assembly 10 is a type well known in the art and forms no part of the present invention but rather is described in order to show advantages of the nailing fin of the present invention over prior art nailing fins.

The nailing fin 11 of the prior art includes a first step 35 of a first plastic material such as polyvinylchloride having nailing holes 36 formed therein and a second narrower band or strip 37 also formed of polyvinylchloride and attached thereto by a very narrow strip or band 38 forming a hinge of flexible material such as polyurethane which may be co-extruded with the opposing bands or strips 35 and 37 of polyvinylchloride. The strip 37 is T-shaped, however, it could be L-shaped. It has a leg 37*a* disposed at right angles to the first strip 35 and a portion adjacent the narrow band 38 of polyurethane. A wing or flange 39 may be formed integrally with the first strip 35 to extend over the narrow band 38 forming the hinge. Extending from the second strip 37 is a barbed member 34 sized to be positioned in kerf 22 and retained therein by barbed sections on the opposing inner surfaces thereof.

The nailing fin 11 may be molded in the position shown in full lines in FIG. 1. After positioning on the window assembly 10, it may be folded so that the first strip 35 is folded about the band 38 of polyurethane from the position shown in FIG. 1 to the position extending along the edge of the window assembly 10 where it will face the rear section 15*b* of the aluminum frame cover 13 as shown in dashed lines of FIG. 1. Although this permits such prior art window frame to be shipped in a smaller shipping container than was previously required when the nailing fin extended directly out of the window assembly in position for affixing in the structure, it lacks a significant advantage which is present in the nailing fin of the present invention.

The nailing fin of the present invention has a construction which permits it to be folded during shipment to a position such that a significant portion thereof will overlie the decorative surface of the aluminum cladding or other structure supporting the window. Thus, as will be appreciated during the rigors of handling in shipment, the surface of the window assembly intended to face outwardly for viewing by a passerby will be subject to the same rigors of scratching and marring as all other portions of the window assembly including those which will be covered following installation in a structure. The plastic nailing fin of the present invention provides a design which causes a leg of such sealing fin to be folded over the front or viewing surface of the aluminum cladding, thereby protecting it during shipment and handling prior to installation in the structure. Additionally, the nailing fin provides under one embodiment a provision for forming the nailing fin out of a single plastic material thus providing the potential for greater economies of manufacture than a nailing fin formed out of different types of plastic which must be co-extruded. Additionally, the nailing fin of the present invention provides means for locking the respective legs or foldable portions of the sealing fin into position for assembly and nailing in the structure following receipt at the job site.

Thus, in contrast to foldable nailing fins of the prior art which have no provision for locking in a folded position and which, therefore, have a tendency to spring back to the "as shipped" position and which provide no protection for the viewing surface of the frame assembly, the nailing fin of the present invention incorporates a locking feature to hold it in a folded position and has a design which protects such viewing surface during shipment.

Figure 2:
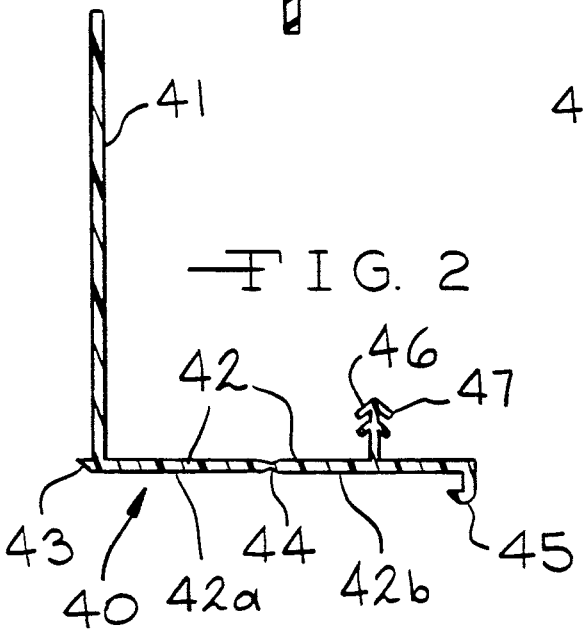
FIG. 2 is a sectional view of the nailing fin of the present invention in the "as extruded" position.
Figure 3:
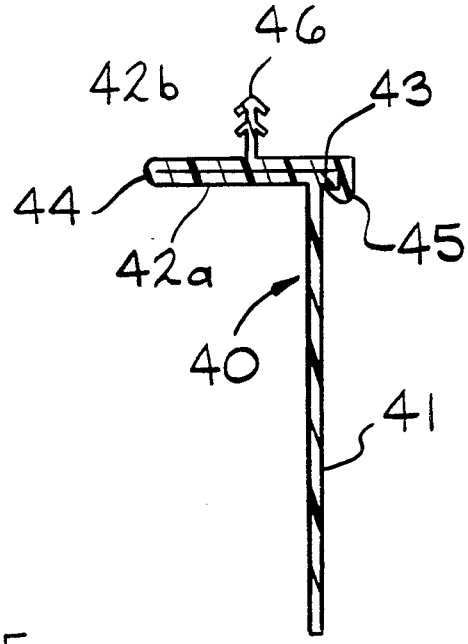
FIG. 3 is a sectional view of the nailing fin of the present invention after folding about the hinged portion.

Referring to FIGS. 2 and 3, there is shown one embodiment of nailing fin 40 according to the present invention. As shown in FIGS. 2 and 3, the nailing fin 40 includes a first leg 41 and a second leg 42 disposed at an angle of 90° thereto. The first leg 41 desirably has nailing holes formed therein. The second leg 42 has an integrally formed latch 43 extending slightly beyond the first leg 41. It also has a hinge portion 44 which, in the embodiment of FIGS. 2 and 3 is extruded of the same plastic materials as the remainder of the nailing fin. Polypropylene is a material which is particularly well-suited for this embodiment in that it possesses sufficient rigidity for the first and second legs 41 and 42 to function properly and yet, by providing a reduced thickness for the hinge 44, permits the structure on opposite sides to be folded thereabout. Thus, the thickness of the first and second legs 41 and 42 is desirably on the order of 0.045 inch (0.114 cm) plus or minus 0.005 inch (0.013 cm) while the thickness at the center of the hinge is approximately one-half the thickness of such first and second legs 41 and 42. The second leg 42 includes an inner segment 42*a* adjacent the first leg 41 and an outer segment 42*b* having an integrally formed hook 45 on one side and, on the other side, an integrally formed retention member 46 having barbs 47 extending therefrom.

FIG. 2 shows the configuration of the nailing fin 40 upon extrusion from a conventional extruder having a die head with an outlet orifice of similar configuration to that of such nailing fin 40. This is the position in which the various elements of the nailing fin 40 will be positioned during shipment following its engagement with a window assembly.

FIG. 3 shows the nailing fin 40 after folding about the hinge 44. Thus, the inner segment 42*a* will be folded about the hinge 44 and brought into interfacial engagement with the outer segment 42*b* and will carry with it the first leg 41 with such folding carrying the first leg 41 to a position generally parallel to its "as extruded" position of FIG. 2 but extending in the opposite direction. As can be seen, the latch 43 engages the hook 45 of the outer segment 42*b* to retain the inner segment 42*a* in interfacial engagement with said outer segment 42*b*.

Referring now to FIGS. 4–7, a modified embodiment will be described in combination with a window assembly 10 of the type previously described with references to FIG. 1. The nailing fin 50 of the embodiment shown in FIGS. 4–7 includes the first leg 51 having nailing holes 56 formed therein and a second leg 52 adjoining said first leg and disposed at an angle of 90° thereto. The second leg 52 has a hinge portion 54 of reduced thickness which divides the second leg 52 into an inner segment 52*a* and an outer segment 52*b*. The outer segment 52*b* has an integrally formed retention member 56 having barbs 57 thereon for engagement and retention in the kerf 22. An integrally molded stop 53 extends outwardly from the surface of the outer segment 52*b* on the opposite side thereof from the retention member 56. The stop 53 is spaced from the hinge 54 a distance which is equal to the distance from the hinge 54 to the outer corner 55 defined by the intersection of the inner segment 52*a* and the first leg 51. Thus, as can be seen by comparing FIGS. 6 and 7, when it is desired to fold the nailing fin from the shipping position of FIGS. 4 and 6 to the position of FIGS. 5 and 7 for nailing in a structure, the corner 55 will frictionally engage the stop 53 thereby retaining the inner segment 52*a* in interfacial engagement with the outer segment 52*b*.

Figure 4:
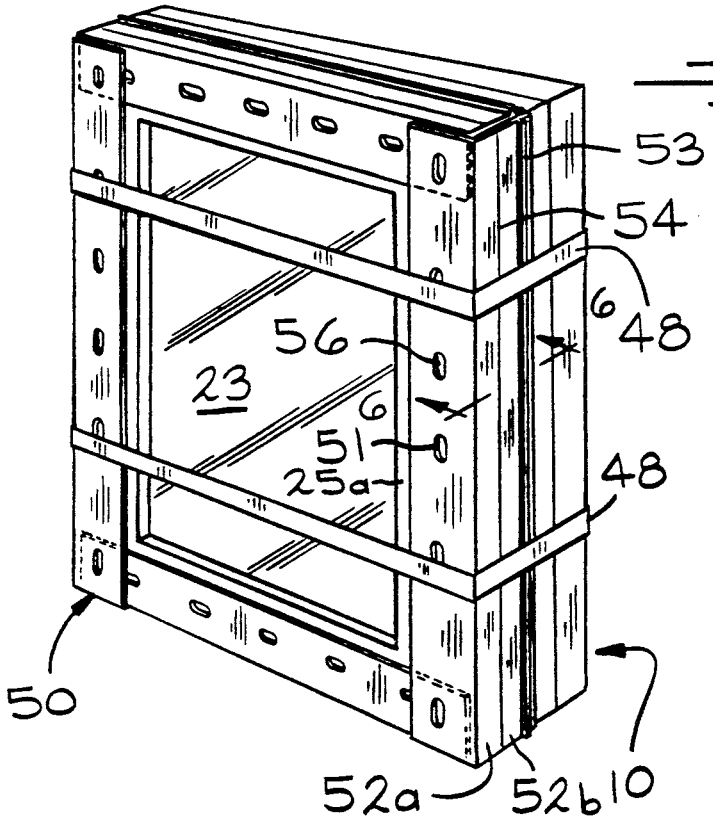
FIG. 4 is a perspective view of a window assembly and nailing fin of the present invention packaged ready for shipment.
Figure 5:
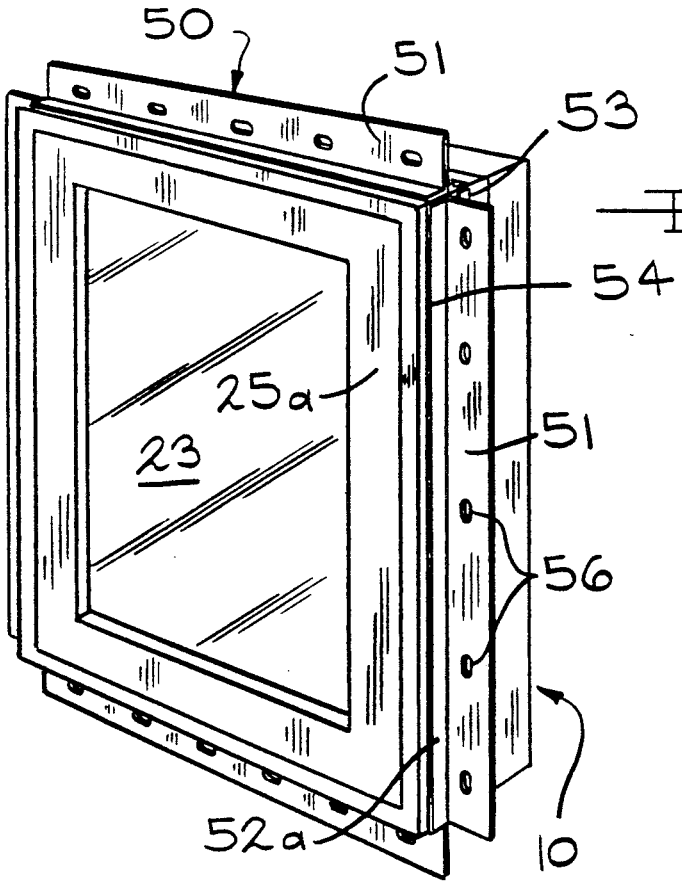
FIG. 5 is a perspective view of a window assembly and nailing fin of the present invention with the nailing fin folded to a position ready for installation in a wall opening.
Figure 6:
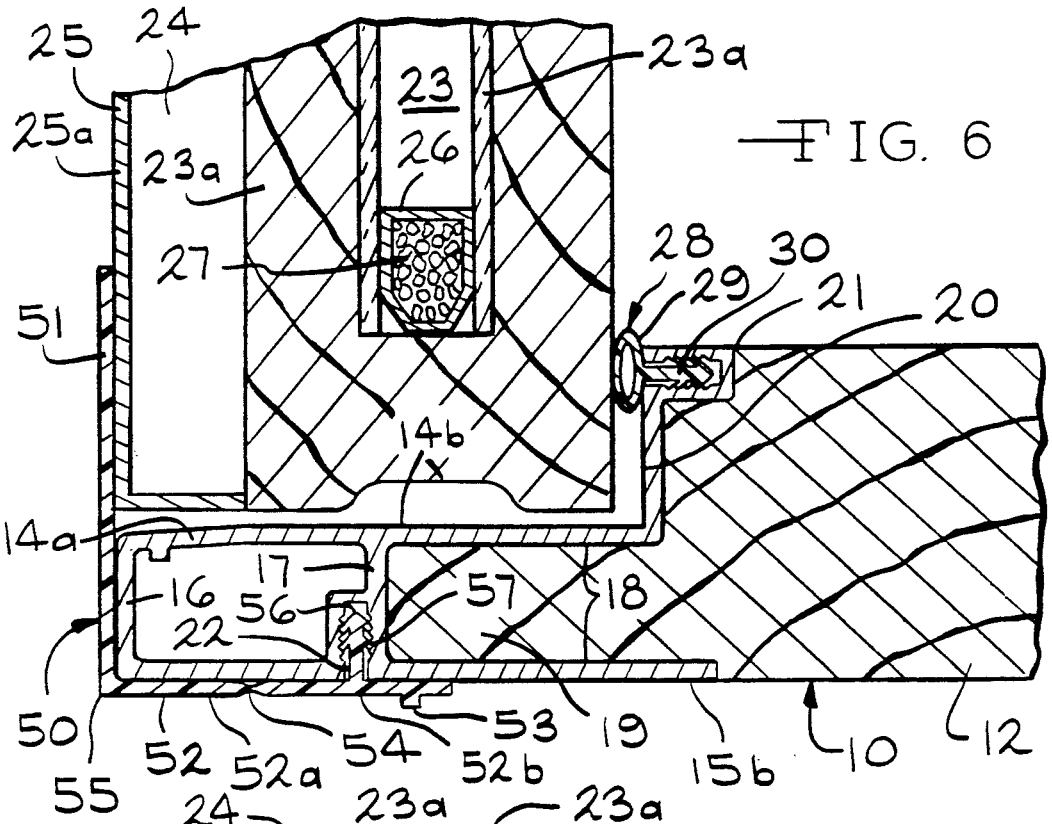
FIG. 6 is a sectional view taken through line 6—6 of FIG. 4.

As can be seen particularly in FIGS. 4 and 6, during shipment, the first leg 51 will overlie a substantial portion of the viewing surface 25*a* of the aluminum sash cover 25 and will serve to provide protection against scratching or marring of such viewing surface. Obviously, if desired, the length of the first segment 51 could be extended to permit such first segment 51 to overlie the complete portion of such viewing surface 25*a*. As will be appreciated from viewing FIG. 4, prior to shipment it is desirable to encircle the assembly and nailing fin combination 50 with strapping material 48 to prevent the nailing fin 50 from being dislodged from the window assembly 10 and to retain the first leg 51 in interfacial engagement with the viewing surface 25*a* of the aluminum sash cover 25.

Figure 7:
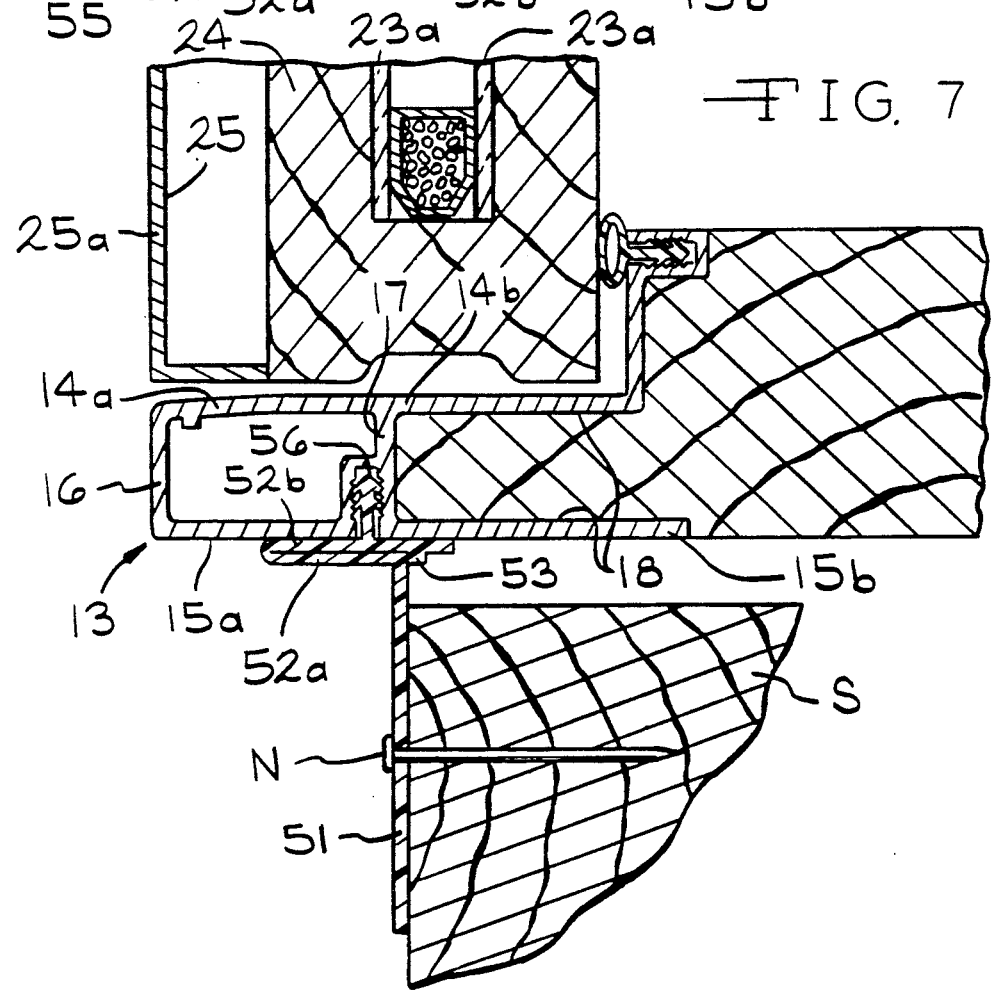
FIG. 7 is a fragmentary sectional view of the window assembly and nailing fin of FIG. 6 after fastening in the opening of a wall in which such assembly is to be located.

As may be seen in FIG. 7, following shipment to the construction site and removal of the strapping material 48, the nailing fin will be folded from the position of FIG. 6 to the position of FIG. 7 where it may be affixed to a support structure S by nails N.

Figure 8:
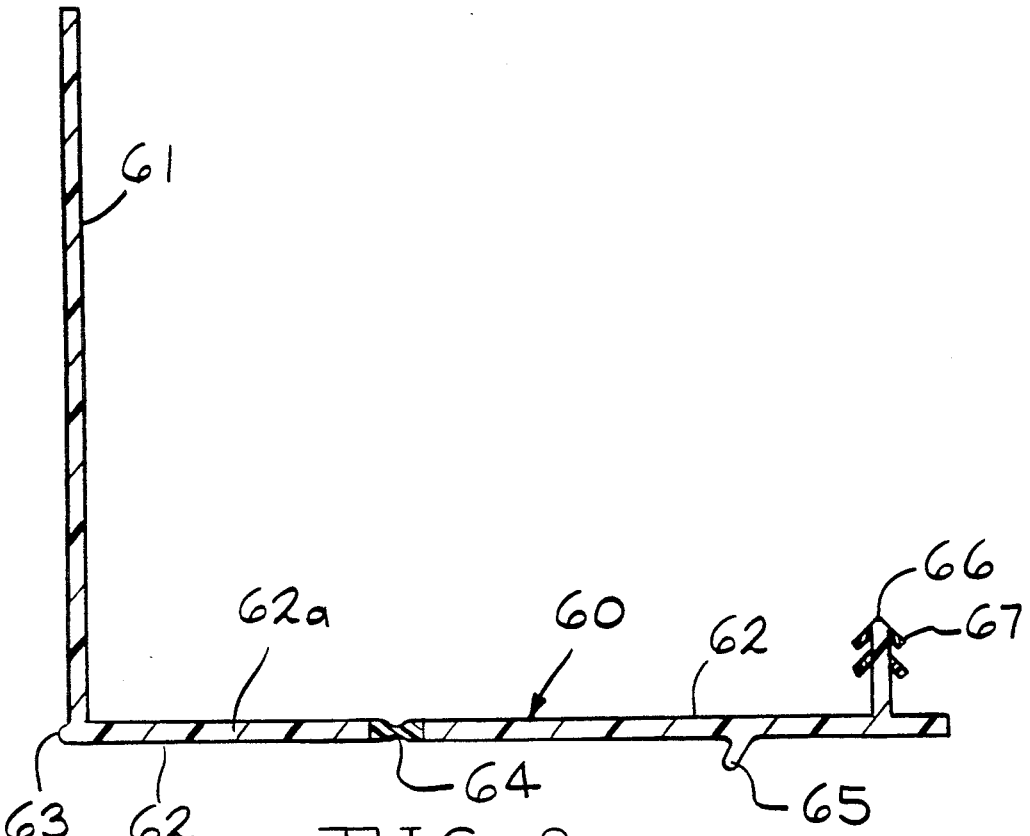
FIG. 8 is a sectional view of another embodiment of the present invention.

Referring now to FIG. 8, there is shown an additional embodiment of nailing fin 60 which includes a first let 61 and a second leg 62 disposed at right angles thereto. Under this embodiment, there is provided a hinge portion 64; however, under this embodiment the material from which the hinge is formed may be a different material than other portions of the nailing fin. For example, under this embodiment, the hinge portion 64 may be formed of a resilient material such as polypropylene, polyurethane or even a rigid polyvinylchloride to which a plasticizer has been added to provide the resilience necessary to permit the hinge portion 64 to function as a hinge. The remainder of the nailing fin may be formed of a less expensive material such as rigid PVC including regrind high density polyethylene or a wide variety of other plastic materials. Since the hinge portion 64 will be co-extruded with the remainder of the nailing fin 60, the only limitation is that the remainder of the nailing fin be formed from a material which may be co-extruded with the material forming the hinge portion 64 such that the hinge portion 64 is a permanent part of the nailing fin 60.

The embodiment shown in FIG. 8 also includes a retention member 66 having barbs 67 for retention in the kerf of a window assembly. If desired, the barbs 67 could also be formed of more flexible, resilient material such as that used in forming the hinge portion 64.

Under this embodiment there is also provided the latch 63 and a hook 65 positioned for engagement by the latch 63 when the inner segment 62*a* of the second leg is folded into engagement with the outer segment 62*b*.

Figure 9:
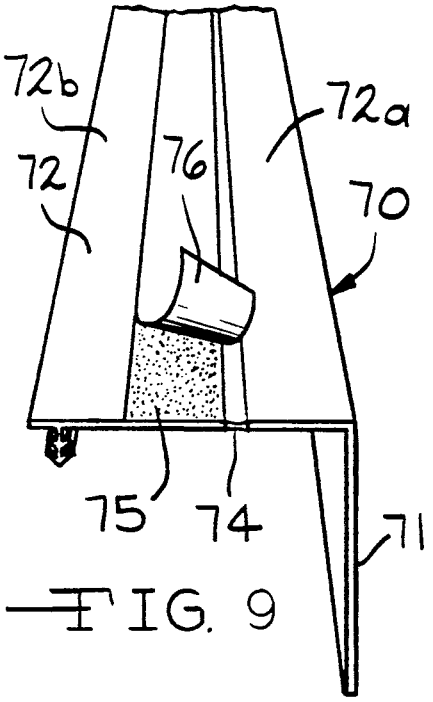
FIG. 9 is a perspective view of yet another embodiment of the present invention.

Referring now to FIG. 9, there is shown another embodiment of nailing fin 70 with a different means for retaining it in a folded position. The nailing fin 70 includes a first leg 71 and a second leg 72 disposed at right angles thereto. A hinge portion 74 separates an inner segment 72*a* from an outer segment 72*b*. Under this embodiment, the surface of the outer segment 72*b* which will be engaged by the inner segment 72*a* upon folding about the hinge portion 74 has adhesive coating 75 applied thereto. The adhesive coating is protected by a peelable cover or release liner 76 formed of paper, plastic or similar material. Prior to folding, the release liner 76 is removed from the outer segment 72*b* so that upon folding of such inner segment about the hinge portion 74, the inner segment 72*a* will become adhesively engaged to such outer segment 72*b*.

Obviously, a wide variety of other means may be utilized for retaining the nailing fin of the present invention in its folded position. For example, the surfaces of the inner segment 72*a* and outer segment 72*b* to become engaged could be formed with hooks and loops to form a fastener of the type sold under the trademark "Velcro".

The nailing fin of the present invention is one which can be economically manufactured, can be readily folded and then retained in the folded position so that it will remain in the desired folded position during and following installation in a structure. Equally important, its design permits it to provide protection to the viewing surface of the aluminum sash cover during shipment and handling.

Many modifications will become readily apparent to those skilled in the art. Accordingly, the scope of the present invention should be limited only by the scope of the appended claims.

We claim:

1. For use with a window assembly having a window glazing enclosed by a surrounding frame, a plastic nailing fin comprising:

(a) a first flat elongated strip of plastic material for attaching to a support structure;

(b) a second elongated strip of material integral with said first strip and adjoining said first strip at a corner, said second strip having, (i) a first segment extending away from said corner at substantially a right angle to said first strip;

(ii) a second segment extending away from said first segment and having means for attaching to an edge of said frame; and (iii) integral hinge means joining said first and second segments, said first segment being foldable about said integral hinge means into engagement with said second segment.

2. A nailing fin according to claim 1, further including means for retaining said first and second segments in engagement with each other.

3. A nailing fin according to claim 2 wherein said retaining means comprises adhesive on at least one of said first and second segments.

4. A nailing fin according to claim 2 wherein said first and second segments are moveable from a substantially planar position with each other to a position, following folding about said hinge, in interfacial engagement with each other and wherein said retaining means comprises loops on one of said segments and hooks on the other of said segments.

5. A nailing fin according to claim 2, wherein said retaining means includes:

(a) latch means extending from said second segment in a direction away from said means for attaching to said edge; and (b) means on said first segment engageable with said latch means when said first segment is folded about said integral hinge means.

6. A nailing fin according to claim 2, wherein said retaining means includes a stop member extending from said second segment in a direction away from said means for attaching to said frame edge and wherein the distance between said integral hinge means and said stop member is substantially equal to the distance between said corner and said integral hinge means, said corner frictionally engaging said stop member upon folding said first segment about said integral hinge means into engagement with said second segment.

7. A nailing fin according to claim 1, wherein prior to folding about said integral hinge means, said first strip is positioned on the same side of said second strip as said means for attaching to said frame and after folding about said integral hinge means, said first strip is positioned on the opposite side of said second strip from said means for attaching to said frame.

8. A nailing fin according to claim 7, further including means for retaining said first and second segments in engagement with each other.

9. A nailing fin according to claim 8, wherein said retaining means comprises adhesive on at least one of said first and second segments.

10. A nailing fin according to claim 8, wherein said first and second segments are moveable from a substantially planar position with each other to a position following folding about said hinge, in interfacial engagement with each other and wherein said retaining means comprises loops on one of said segments and hooks on the other of said segments.

11. A nailing fin according to claim 8, wherein said retaining means includes:

(a) latch means extending from said second segment in a direction away from said means for attaching to said edge; and (b) means on said first segment engageable with said latch means when said first segment is folded about said integral hinge means.

12. For use with a frame assembly having a front viewing surface and an edge extending inwardly therefrom, a plastic nailing fin comprising:

(a) a first leg having means on a first surface for attaching to said frame edge;

(b) a second leg disposed in a first position at substantially right angles to said first leg; and (c) hinge means in said first leg positioned between said means for attaching to said frame and said second leg, said hinge means dividing said first leg into an interior segment from which said attaching means extends and an exterior segment from which said second leg extends, said exterior segment being foldable about said hinge means from a position aligned with and parallel to said interior segment to a position folded upon and in engagement with said interior segment, said second leg, upon said exterior segment being folded, moving from said first position to a second position at substantially right angles to said first leg but extending in an opposite direction from said first position.

13. A nailing fin according to claim 12 further including means for retaining said exterior segment in said folded position.

14. A nailing fin according to claim 13, wherein said retaining means comprises adhesive on at least one of said interior and exterior segments.

15. A nailing fin according to claim 13, wherein said retaining means comprises loops on one of said interior and exterior segments and hooks on the other of said segments.

16. A nailing fin according to claim 13, wherein said retaining means includes:

(a) latch means extending from said interior segment in a direction away from said means for attaching to said frame edge; and (b) means on said exterior segment engageable with said latch means when said exterior segment is folded about said integral hinge means.

17. A nailing fin according to claim 13, wherein said retaining means includes a stop member extending from said interior segment in a direction away from said means for attaching to said frame edge and wherein the distance between said integral hinge means and said stop member is substantially equal to the distance between the end of said exterior segment and said integral hinge means, said end frictionally engaging said stop member upon folding said exterior segment about said integral hinge means into engagement with said interior segment.

18. Foruse with a window assembly to be fastened in a structure, said window assembly having a window glazing encircled by a surrounding frame said frame having a front viewing surface and an edge extending inwardly therefrom, a plastic nailing fin comprising:

(a) a first leg having means on a first surface for attaching to said frame edge; and (b) a second leg disposed in a first position at substantially right angles to said first leg and extending in a direction to overlie said frame viewing surface when said first leg is attached to said frame edge; and (c) hinge means in said first leg positioned between said means for attaching to said frame and said second leg, said hinge means dividing said first leg into an interior segment from which said attaching means extends and an exterior segment from which said second leg extends, said exterior segment being foldable about said hinge means from said first position to a second position folded upon and in engagement with said interior segment, said second leg, in said second position, being located for fastening in said support structure.

19. A nailing fin according to claim 18, further including means for retaining said exterior segment in said folded position.

20. A nailing fin according to claim 19, wherein said retaining means comprises adhesive on at least one of said interior and exterior segments.

21. A nailing fin according to claim 19, wherein said retaining means comprises loops on one of said segments and hooks on the other of said segments.

22. A nailing fin according to claim 19, wherein said retaining means includes:

(a) latch means extending from said interior segment in a direction away from said means for attaching to said frame edge; and (b) means on said exterior segment engageable with said latch means when said exterior segment is folded about said integral hinge means.

23. A nailing fin according to claim 19, wherein said retaining means includes a stop member extending from said interior segment in a direction away from said means for attaching to said frame edge and wherein the distance between said integral hinge means and said stop member is substantially equal to the distance between the end of said exterior segment and said integral hinge means, said end frictionally engaging said stop member upon folding said exterior segment about said integral hinge means into engagement with said interior segment.

24. A frame assembly intended for installation in a support structure comprising in combination:

(a) a frame having a front surface intended for viewing and edges encircling said front face, said edges having attaching means formed herein; and (c) a plastic nailing fin engaged to the attaching means of at least one of said edges, said plastic nailing fin including (i) a first leg having means on a first surface for engaging said attaching means;

(ii) a second leg moveable from a first position at substantially right angles to said first leg and overlying the portion of said frame front surface adjacent said edges to a second position extending away from said edges for engagement with said support structuref and (iii) hinge means in said first leg positioned between said means for engaging said edge attaching means and said second leg, said hinge means dividing said first leg into interior and exterior segments, said exterior segment adjoining said second leg and being foldable about said hinge means to move said second leg from said first position to said second position.

25. The combination according to claim 24 further including means for retaining said exterior segment in said folded position.

26. A nailing fin according to claim 25, wherein said retaining means comprises adhesive on at least one of said interior and exterior segments.

27. A nailing fin according to claim 25, wherein said retaining means comprises loops on one of said interior and exterior segments and hooks on the other of said segments.

28. A nailing fin according to claim 25, wherein said retaining means includes:

(a) latch means extending from said interior segment in a direction away from said means for attaching to said frame edge; and (b) means on said exterior segment engageable with said latch means when said exterior segment is folded about said integral hinge means.

29. A nailing fin according to claim 25, wherein said retaining means includes a stop member extending from said interior segment in a direction away from said means for engaging said frame edge attaching means and wherein the distance between said integral hinge means and said stop member is substantially equal to the distance between the end of said exterior segment and said integral hinge means, said end frictionally engaging said stop member upon folding said exterior segment about said integral hinge means into engagement with said interior segment.

* * * * *